US005338239A

United States Patent [19]

Cleaveland

[11] Patent Number: 5,338,239

[45] Date of Patent: Aug. 16, 1994

[54] AUTOMATIC INFLATABLE PFD

[76] Inventor: Earl G. Cleaveland, 1475 Flamingo Dr. 167 Engle, Englewood, Fla. 34224

[21] Appl. No.: 38,224

[22] Filed: Mar. 29, 1993

[51] Int. Cl.[5] ..... B63C 9/08

[52] U.S. Cl. ..... 441/106; 441/94

[58] Field of Search ..... 441/88, 106, 107, 108, 441/114, 115, 116, 117, 118

[56] References Cited

U.S. PATENT DOCUMENTS

| | | | |
|---|---|---|---|
| 3,266,070 | 8/1966 | O'Link | 441/112 |
| 3,809,288 | 4/1974 | Mackal | 441/94 |
| 4,097,947 | 7/1978 | Kiefer | 441/116 |
| 4,917,641 | 4/1990 | Katoh | 441/115 |

*Primary Examiner*—Jesus D. Sotelo

*Attorney, Agent, or Firm*—Gifford, Groh, Sprinkle, Patmore & Anderson

[57] ABSTRACT

An automatic, wearable, manually operated or orally inflated personal flotation device that is extremely comfortable in any weather. It consists of a mesh vest, a folded float, stretch material compartment for the float and a reliable and easily operated and understood actuator. This vest has the ability upon inflation to turn a person, conscious or not, onto their back with face out of water. It uses a $CO^2$ cartridge for automatic and manually operated modes, and can be used without the actuator, depending only on oral inflation. The vest can be worn alone, over clothing, or inconspicuously under or between layers of clother. The entire vest complete with $CO^2$ cartridge, actuator and float, weighs approximately eight ounces, and is re-usable by replacing the $CO^2$ cartridge and inexpensive water-soluble tablet.

4 Claims, 3 Drawing Sheets

AUTOMATIC INFLATABLE PFD

FIELD OF INVENTION

This invention relates to a wearable automatic inflatable personal flotation device, specifically to improvements in the vest and the automatic actuator.

DESCRIPTION OF THE PRIOR ART

The prior art has in a large way ignored the reasons behind numerous drownings due mainly to the uncomfortable design which makes them unwearable in hot/-warm weather when the greatest number are fishing or boating. Prior art people have not thought of the solution and one is sorely needed. Refering to the following patents:

1. In U.S. Pat. No. 4,917,641, Apr. 17, 1990-Katoh, approximately 50% of the torso is covered with an airtight material.
2. In U.S. Pat. No. 3,266,070, Aug. 16, 1966-O'Link, approximately 30% of the torso is covered with an airtight material with numerous pockets adding to the discomfort.
3. In U.S. Pat. No. 4,097,947, Jul. 4, 1978-Kiefer shows a vest with over 80% of the torso covered with an airtight material rendering it unwearable in warm weather.
4. In U.S. Pat. No. 4,687,451, Aug. 18, 1987-Chen covers an automatic actuator having the following drawbacks:
   - (a) The mounting nut for the valve and the screw for fastening to the $CO^2$ cartridge require tools.
   - (b) The operating lever rides on the smooth end of the piston making it possible to slip off to one side causing failure.
   - (c) The spring is welded to the inside top of the cylinder and the other end to the top of the piston preventing disassembly for cleaning or parts replacement.
   - (d) The spring is too short, requiring it to be too stiff and making cocking of the device difficult.
   - (e) The requiring of a special water-soluble ring and no available substitute is a drawback.

OBJECTS AND ADVANTAGES

This invention solves the vest problems by using a flexible plastic for the float material with a unique method of folding so as to reduce to about 8%, the area of the torso covered by an airtight material, which is the main cause of discomfort in hot/warm weather. The use of stretch material for the float compartment and the folding of the float twice into itself makes the whole vest very comfortable to wear. The vest is constructed of cool mesh material, with the exception of the panel of light, cool, stretch material, which is attached to the front and forms the compartment for the float to expand into, from its folded position low in the front panel of the vest. This vest is wearable alone, over clothing, inconspicuously under or between layers of clothing. Along with the lack of pockets it is the ultimate in warm weather comfort and safety. With its Velcro shoulder bonds, lacing both sides, a draw-string and slide fastener, it can be donned in less than 15 seconds once adjusted to the individual. It can be worn inconspicuously under clothing, before going on the water, even before leaving home. With adjustments, it can be worn over a warm jacket for cold weather or under warm clothing with the only requirement being that the clothing over the vest be porous and stretchable such as a sweater or jersey.

This vest equipped with its automatic actuator will upon immersion in water, inflate and turn a person onto their back with face out of water, whether conscious or not, as in heart attack or boating accident. In reference to #4(a) above, instead of a stud for mounting, a nut is bonded inside the float so a screw with a large enough slot to accommodate any coin is used, and the wing nut for mounting to the $CO^2$ cartridge eliminates the need for any tools. In reference to #4(b) there is an insert in the top of the piston which is slotted to prevent the lever from slipping to one side causing failure. In reference to #4(c) the actuator lever is designed to use stops in the valve limiting its travel, and holding piston and spring under pressure after triggering. This allows disassembly for cleaning or parts replacement. In reference to #4(d) The spring is twice as long so less stiff making for easier cocking plus being essential for holding pressure on piston and spring as in #4(c). In reference to #4(e) a uncoated aspirin tablet can be an emergency water-soluble tablet with this actuator in case the special colored tablet is not readily available.

SUMMARY

To avoid the limitations and problems with present flotation devices this invention provides a flotation device that is so comfortable that it WILL be worn. It has no bulky parts to interfere with normal activity and consists of a vest, improved automatic actuator, and a folded into itself float, that expands and inflates upon immersion in water, and because the flotation is entirely on the front, center of the body, will turn a person onto his or her back, conscious or not, with face out of water.

This personal flotation device consists of three parts all working together to accomplish the desired performance. The vest is of cool comfortable mesh material with lacing both sides, shoulder fasteners, a slide fastener and a draw string for adjustable comfortable fit which can be worn over, by itself, or inconspicuously under or between layers of clothing. It contains a front panel of stretch fabric, encasing the folded into itself float reducing the area covering the body. The improved actuating device that is dependable, reliable and easy to use and service. The puncture pin design has been improved to increase reliability and to slow the rate of $CO^2$ gas escape, enabling the float to unfold properly. The improved operating lever for the valve has limited travel preventing the loss of piston and spring. It can be reset with a new $CO^2$ cartridge and tablet without the use of tools. The actuator can also be used manually by pulling a cord attached to a small float. The folded into itself float, may also be inflated orally through a tube on the vest.

Further objects and advantages of my invention will become apparent from a consideration of the drawings and ensuing description.

DETAILED DESCRIPTION

Figure 1:
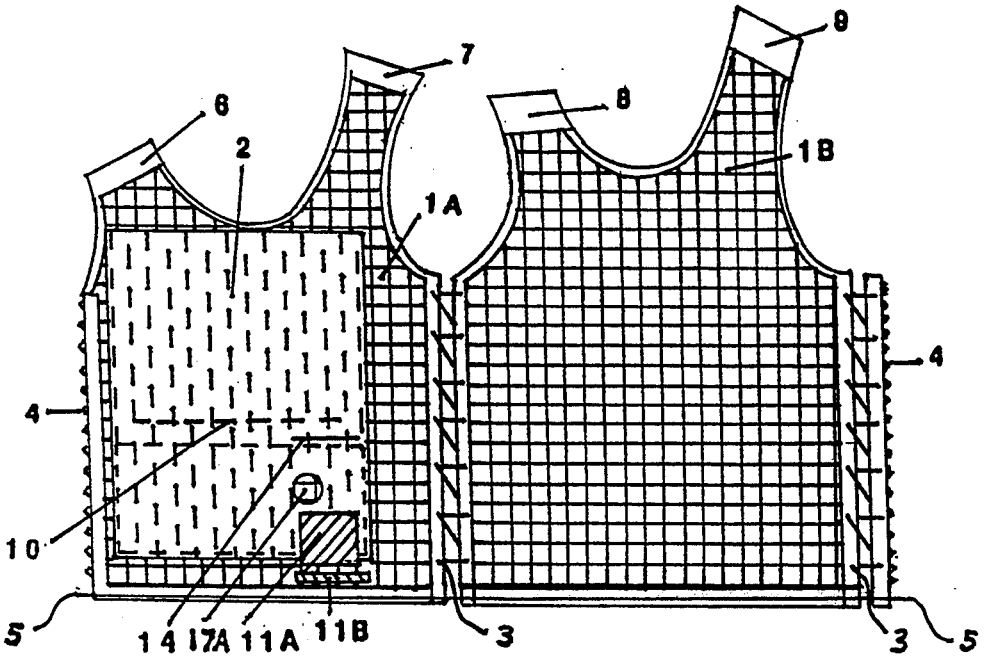
FIG. 1 is a view of the vest showing front and rear half of mesh, a panel of stretch nylon, lacing, slide fastener, draw string, Velcro shoulder bonds, a pocket for the support of the $CO^2$ cartridge and actuator and the Velcro strip for the low end of covering flap.

FIG. 1: The vest is made of knotless mesh fabric 1A and 1B. 1A being the front half and 1B the rear half. There is a panel of light weight, porous, stretch material 2 firmly attached at all edges to the mesh 1A forming an expandable compartment for the float (bladder). The vest is made with lacing on both sides 3, a slide fastener 4 at right front, a drawstring 5 at the waist, shoulder bonds of Velcro 6, 7, 8, and 9 and a slide fastener not shown but located in the mesh 1A behind the line 10 on the panel 2, for access to the float. This design makes for wide latitude in adjustment, both for torso length and girth. Once adjusted to the individual, it requires less than 15 seconds to don. There is a pocket 11A to support the complete actuator and $CO^2$ cartridge. There is also a waterproof stretch material flap attached to the outer panel 2 at position 14 which bonds at the bottom by Velcro at 11B covering the outside of the mechanism while leaving sides open for water access. The panel 2 being of stretch material lies perfectly flat on the mesh 1A until inflation. All edges are finished with a smooth material.

Figure 2:
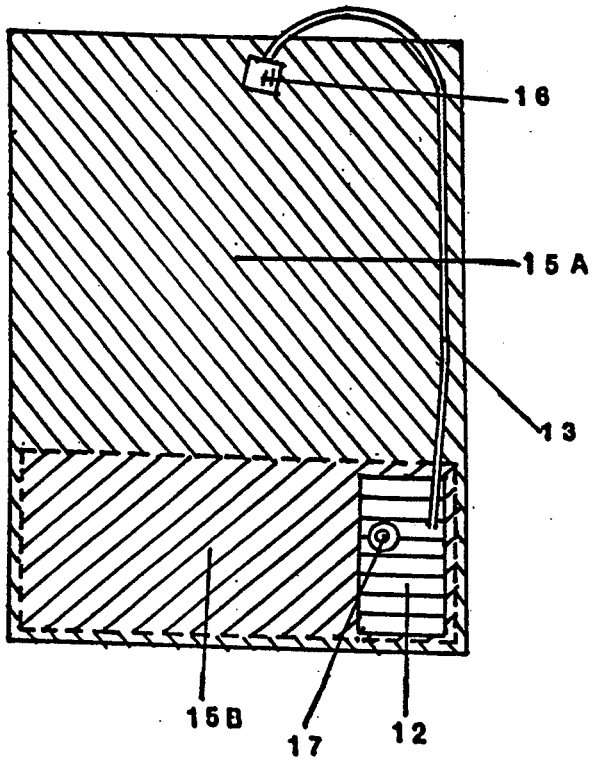
FIG. 2 This is a front elevated view of the float, showing the relative area folded and deflated 15B and unfolded 15A. Also shown is the blow tube, valve, location of stiff plastic section and the location of the nut bonded inside the float.

FIG. 2: The float is made of a puncture resistant plastic that can be folded into itself in such a way that it measures only $4\frac{1}{2}'' \times 11\frac{1}{2}''$ and occupies approximately one fourth of the area of the compartment formed by panel 2 and mesh 1A, FIG. 1, before inflation and entirely fills the compartment under panel 2, FIG. 1, upon inflation. Reference 15A shows the relative size of the float when deflated and unfolded ($11\frac{1}{2}'' \times 18''$). Reference 12 indicates the stiff plastic section that is bonded to the float. Reference 17 is the location of the permanently bonded nut and washer on the interior of the float. Reference 13 is the blow tube for oral inflation and 16 the shut-off valve. The float inflated measures approximately $16'' \times 10'' \times 6''$ and has a buoyancy of twenty-five pounds.

Figure 3:
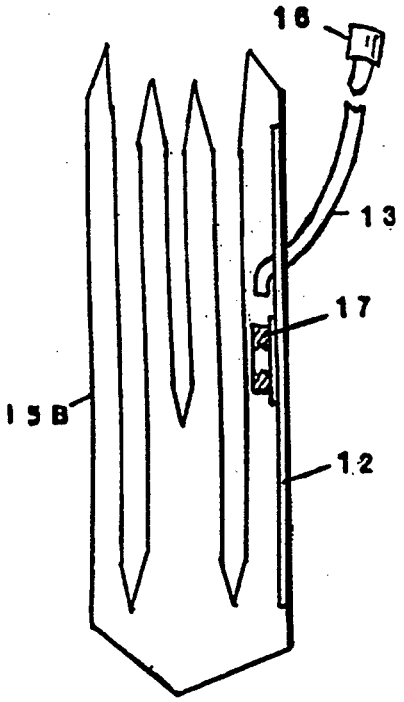
FIG. 3 is a partially exploded end view of the float showing the manner of folding, location of stiff plastic section, mounting nut, blow tube and valve.

FIG. 3: This shows the method of folding the float 15B so that it will properly expand upon inflation and fill the compartment at the front of the vest. Also shown, is the blow tube 13 which extends upwardly between panel 2 and mesh 1A of FIG.1 and exits at the left shoulder available for inflation by mouth. Also shown is a shut-off valve 16. The nut and washer 17, as a single unit, is shown bonded to the inside of the float. When ready for use the float is, at its thickest, $\frac{1}{4}''$.

Figure 4:
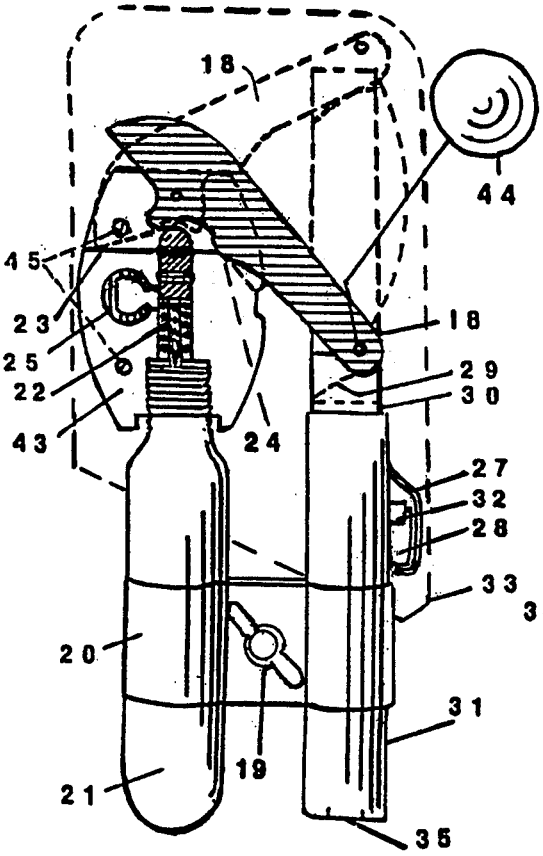
FIG. 4 is a front, cut-away view of the automatic actuator.
Figure 8A:
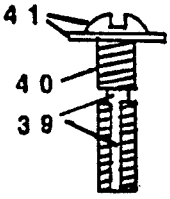
FIGS. 8A, 8B is a detailed view of mounting screw.

FIG. 4: This shows the complete actuator, less spring 36. The actuator consists of a commercially available valve with modifications to adapt it to this vest. The lever 18 is of a new design, and is limited in its travel as shown by the solid and dotted lines by using stops at 23 and 24. This prevents the loss of the spring 36 and piston 30 because the spring maintains pressure on the piston after activation thereby locking it in place. Removal of the piston, spring and cylinder requires only the loosening of wing nut 19. The cam of the lever 18 impels the puncture pin 22 into the seal of the CO2 cartridge 21 which releases the gas into the float through hole 25, which is sealed at the top and bottom by "O" rings and screw 40, FIG. 8A. This action occurs when the lever 18 is propelled from its solid line, cocked position, to its dotted line position, by the release of compressed spring 36, FIG. 6, when the water-soluble tablet 28 dissolves. The lever 18 is shown in the slot of inset 29 at the end of piston 30, so it cannot slip to one side, causing failure. The hole in the end of lever 18 is for a manual trip cord and small float 44. Sleeve 20 is permanently bonded to cylinder 31 and has a wing nut 19 for fastening sleeve to $CO^2$ cartridge 21. Reference 35 indicates location of $\frac{1}{4}''$ hole in cylinder 31 to speed action. Dashed line 33 represents the stiff plastic made a part of the valve body 43. Reference 33 is one of two plastic shields to protect the mechanism from interference by clothing. One is permanently bonded to the underside of the valve the other is removable and mounts on the outside of the valve by two small screws 45 leaving both sides open for water access and assembly.

Figure 5A:
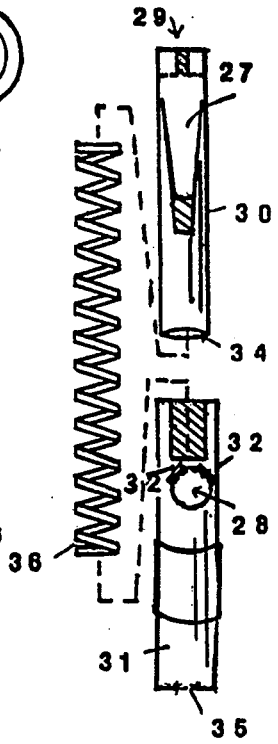
FIGS. 5A, 5B show the spring and front and side elevated views of the piston and cylinder.
Figure 5B:
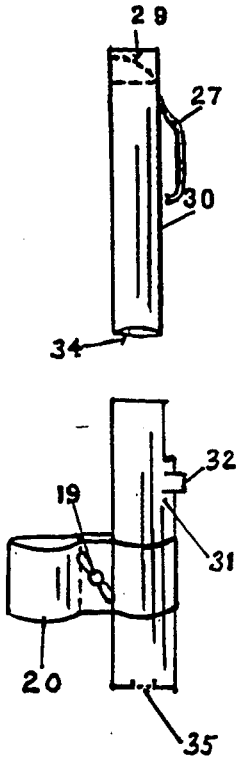

FIGS. 5A, 5B: This shows details of the piston 30, cylinder 31, and spring 36. Also shown are the ears 32, arm 27, and location of water-soluble tablet 28. Reference 34 shows the lower end of the piston 30 to be open. Reference 36 is the spring which extends its full length into piston 30 and cylinder 31. 35 is the $\frac{1}{4}''$ hole to speed action and 29 the slot in the end of the piston.

Figure 6:
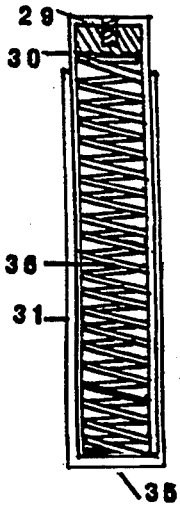
FIG. 6 is a view of the piston and cylinder in cocked condition.

FIG. 6: Shows the spring 36 compressed within the piston 30 and cylinder 31 as in cocked condition.

Figure 7:
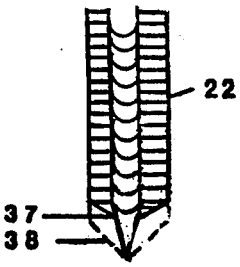
FIG. 7 is an exploded view of the modification of puncture pin.

FIG.7: This is an exploded view of the modification 37 of the puncture pin 22, the original shape shown as 38. This change not only assures a more positive puncture, but makes a smaller hole which is necessary to allow an extra second for the float to unfold and fully inflate the compartment 2 FIG. 1.

Figure 8B:
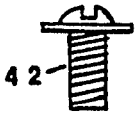

FIG. 8: This shows the valve mounting screw 40 with bonded head and washer 41 and gas slots 39. Also shown in FIG. 8B is screw 42 which is supplied for closing the actuator mounting hole when vest is to be used merely as a float, to be inflated orally as when swimming and tiring.

Figure 9:
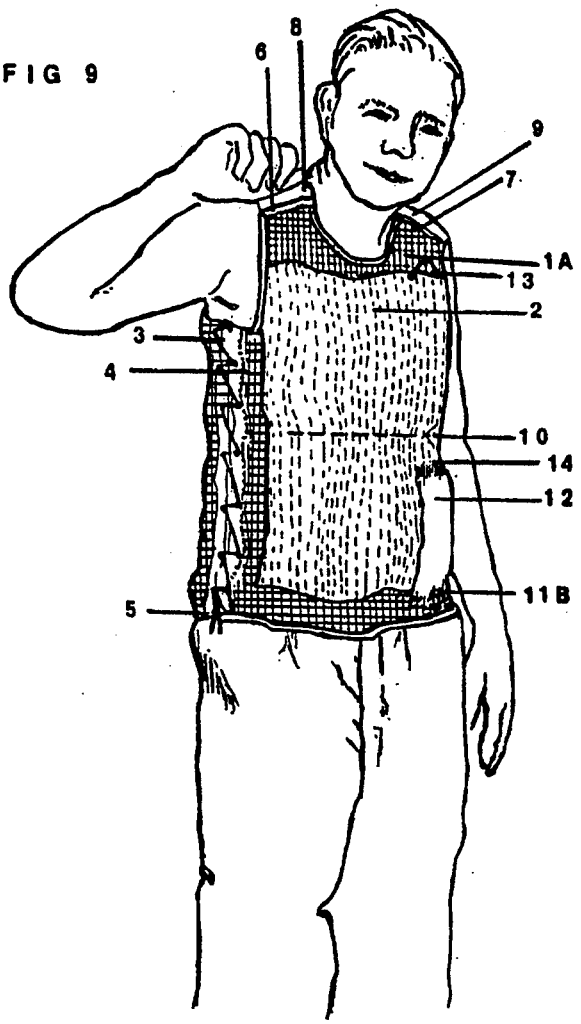
FIG. 9 is a front view of the vest as worn.

FIG. 9: Is a frontal view of vest being worn showing lacing 3 and slide fastener 4 on right side and actuator as it would look covered by flap at position 14 fastened by Velcro at 11B.

Figure 10:
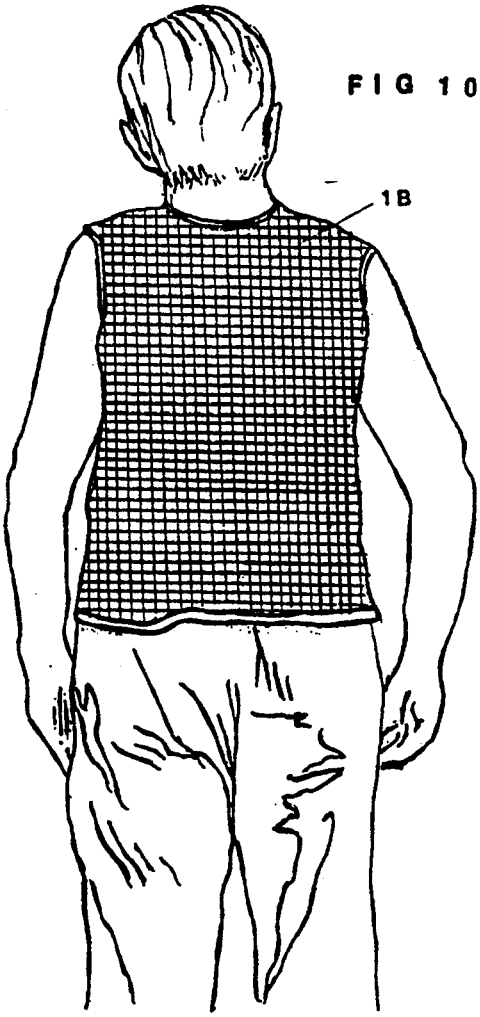
FIG. 10 is a rear view of the vest as worn.

FIG. 10: Is a rear view of vest being worn showing that the back of the body is covered only by mesh material 1B.

DESCRIPTION OF THE PREFERRED EMBODIMENT

For automatic inflation: The actuator is prepared for use by first inserting the spring 36 into piston 30 and cylinder 31, FIG. 5A, then compressing piston and cylinder together with one hand, insert the blocking means (water-soluble tablet) 28, FIG. 4, under the arm 27 as shown, between the ears 32 and the lip of arm 27. Release compression and tablet 28 will hold actuator in cocked condition. With lever 18, FIG. 4, in the down (shaded) position, screw a full $CO^2$ cartridge firmly into the valve 43, FIG. 4. With wing nut 19 loosened, slide the cylinder 31, piston 30, spring 36, FIG. 5A and sleeve 20, FIG. 4, combination onto the $CO^2$ cartridge until the lever 18 is just settled into the slot 29 at the top of piston 30, and while holding in this position tighten the wingnut 19. Entire preparation can be done in less than 30 seconds.

For manual inflation: Only the valve 43, FIG. 4, $CO^2$ cartridge 21 and small float and cord 44 are required. An upward pull on the cord 44 will trigger the actuator, inflating the float immediately.

For oral inflation: Only screw 42, FIG. 8B is required to seal the valve mounting hole 17, FIG. 2, and inflate by mouth through tube 13 and valve 16 which may be either a check valve or manual type.

Float preparation: FIG. 3 shows method of folding the float with a small amount of air in the float. Both sides are folded into the outer layer leaving about 4" to be similarly folded into the remaining inside fold. Now press out remaining air. Open the slide fastener in the front mesh 1A, FIG. 1, at location 10, insert the folded float so the hole at 17, FIG. 2, aligns with the hole 17A, FIG. 1, route the blow tube 13, FIG. 2, up under the panel 2, FIG. 1, and out at the top left corner, accessible by mouth.

Vest preparation: With float installed and automatic operation desired, mount the cocked and ready actuator on the float by use of screw 40, FIG.8A at the hole and nut at 17, FIG. 2, which is accessible through the hole 17A in panel 2, FIG. 1. Enclose the lower end of the $CO^2$ cartridge 21 and cylinder 31, FIG. 4, into the pocket 11A, FIG. 1. A coin can be used to firmly tighten valve in place. The water-proof flap at 14 can be fastened over the unit by Velcro at 11B, FIG. 1. Now the vest may be donned and adjusted by Velcro shoulder bonds 6, 7, 8 and 9, FIG. 1, and lacing 3 for a comfortable fit with slide fastener 4, FIG. 1, closed. Once adjusted to size this vest can be put on in 15 seconds or less. Depending on adjustments it can be worn alone, over clothing or inconspicuously under or between layers of clothing. The only requirement for clothing worn over the vest is that it be porous and stretchable such as a sweater or jersey.

Operational description: Upon immersion in water (fresh for salt) the water-soluble tablet 28, FIG. 4, disintegrates, the pressure of spring 36, FIG. 6, upward on piston 30, FIG. 4, forces lever 18 to its upper (dotted line) position and the cam of the lever 18 impels the puncture pin 22 into the seal of the $CO^2$ cartridge 21 and partially retracts it. The $CO^2$ gas escapes through hole 25, FIG. 4, and slots 39 in screw 40, FIG.8A into float 15B, FIG. 2 fully inflating same. Hole 25, FIG. 4, is sealed top and bottom to the outside by "O" rings. The piston 30 is locked in place after activation by the lever 18, slot 29, FIG. 4, and remaining spring pressure. For cleaning or replacement of parts, merely loosen wing nut 19, FIG. 4, and slide piston, cylinder and spring assembly off the $CO^2$ cartridge.

What is claimed is:

1. An inflatable personal floatation device comprising:

a vest that is wearable alone, over or inconspicuously under or between layers of clothing, said vest having a forward and rearward panel of a porous material, a float compartment formed on a forward one of said panels of said vest to define an area adjacent to the front central portion of the torso of a wearer, a single, inflatable float disposed in said compartment, said float being of airtight material and folded in its deflated condition to occupy only a portion of said area of said compartment to reduce the surface area of said airtight float adjacent to the torso of the wearer, at least one wall of said compartment being of a stretchable material to allow the float to fully expand upon inflation, a nut sealed to said float and having screw receiving threads communicating with the interior of said float, and means for inflating said float including a valve having a screw portion receivable in said nut.

2. The combination of claim 1 wherein said float compartment occupies a substantial portion of said forward panel to hold said float in its inflated and unfolded condition to occupy all of said compartment at the forward central portion of the torso of a wearer.

3. The combination of claim 1 wherein said float is folded with portions of its walls folded within each other to form a small flat shape adjacent to a minimum portion of the torso of a wearer.

4. The combination of claim 1 wherein said means to inflate said float includes a gas cartridge responsive to being submerged in water to inflate said float.

* * * * *